US009920430B2

(12) United States Patent
Riener et al.

(10) Patent No.: US 9,920,430 B2
(45) Date of Patent: Mar. 20, 2018

(54) METHOD FOR IMPROVING ADHERENCE

(71) Applicant: VOESTALPINE STAHL GMBH, Linz (AT)

(72) Inventors: Christian Karl Riener, Linz (AT); Daniel Roman Fritz, Linz (AT); Josef Hagler, Leonding (AT); Harald Haslinger, Linz (AT); Edmund Holzer, Marchtrenk (AT); Gerald Luckeneder, Pinsdorf (AT)

(73) Assignee: voestalpine Stahl GmbH, Linz (AT)

( * ) Notice: Subject to any disclaimer, the term of this patent is extended or adjusted under 35 U.S.C. 154(b) by 131 days.

(21) Appl. No.: 14/904,618

(22) PCT Filed: Jul. 11, 2014

(86) PCT No.: PCT/EP2014/064987
§ 371 (c)(1),
(2) Date: Jan. 12, 2016

(87) PCT Pub. No.: WO2015/004284
PCT Pub. Date: Jan. 15, 2015

(65) Prior Publication Data

US 2016/0160357 A1 Jun. 9, 2016

(30) Foreign Application Priority Data

Jul. 12, 2013 (EP) ..... 13176397

(51) Int. Cl.
*C23C 22/83* (2006.01)
*C23C 2/26* (2006.01)
(Continued)

(52) U.S. Cl.
CPC ..... *C23C 22/83* (2013.01); *C23C 2/26* (2013.01); *C23C 2/40* (2013.01); *C23C 22/34* (2013.01);
(Continued)

(58) Field of Classification Search
None
See application file for complete search history.

(56) References Cited

U.S. PATENT DOCUMENTS

2009/0255608 A1* 10/2009 Brouwer ..... C23C 22/365 148/241
2010/0068555 A1* 3/2010 Tomandl ..... B05D 7/14 428/626
(Continued)

FOREIGN PATENT DOCUMENTS

EP 1524326 A1 4/2005
EP 2092090 B1 12/2012
(Continued)

*Primary Examiner* — Erma C Cameron

(57) ABSTRACT

A method for improving the adhesive capacity of a protectively coated steel sheet is proposed, in which, in a continuous process, a protective coating based on Zn—Al—Mg is applied to the steel sheet and, in a further step, the protective coating undergoes a surface treatment in which an aqueous composition is applied in order to modify the natural oxide layer, which contains $Al_2O_3$ and MgO, without pickling this natural oxide layer as a result. In order to significantly increase adhesive capacity of the protectively coated steel sheet, the invention proposes skin-pass rolling the protectively coated steel sheet and then reacting the natural oxide layer with an aqueous fluoride-containing composition, reducing its MgO content in order to thus modify the natural oxide layer.

20 Claims, 2 Drawing Sheets

(51) Int. Cl.

| | |
|---|---|
| ***C23C 2/40*** | (2006.01) |
| ***C23C 22/34*** | (2006.01) |
| ***C23C 22/68*** | (2006.01) |
| ***C23G 1/10*** | (2006.01) |
| ***C23G 1/24*** | (2006.01) |
| ***C23C 22/73*** | (2006.01) |

(52) U.S. Cl.
CPC ..... *C23C 22/68* (2013.01); *C23C 22/73* (2013.01); *C23G 1/10* (2013.01); *C23G 1/24* (2013.01)

(56) References Cited

U.S. PATENT DOCUMENTS

2011/0132052 A1* 6/2011 Faderl ..... C23C 2/02 72/47
2011/0308673 A1* 12/2011 Schneider ..... C21D 6/005 148/546

FOREIGN PATENT DOCUMENTS

JP 2002194557 A 7/2002
WO 2006045570 A1 5/2006
WO 2013027837 A1 2/2013

* cited by examiner

METHOD FOR IMPROVING ADHERENCE

TECHNICAL FIELD

The invention relates to a method for improving the adhesive capacity of a protectively coated steel sheet in which, in a continuous process, a protective coating based on Zn—Al—Mg is applied to the steel sheet and in a further step, the protective coating undergoes a surface treatment in which an aqueous composition is applied in order to modify the natural oxide layer, which contains $Al_2O_3$ and MgO, without pickling this natural oxide layer as a result.

BACKGROUND OF THE INVENTION

Methods for passivation of protectively coated steel sheets are sufficiently well-known. Examples of these include chromating and phosphating (FP2092090B1). A common feature of all of these methods, however, is the removal or pickling of the natural or native oxide layer and replacement of it by another passivation layer. Such passivation layers can contribute, among other things, to improving the adhesion to an organic coating, e.g. of paints. In a subsequent processing of the protectively coated steel sheet, it is impossible to avoid a partial removal of the passivation layer. In addition to requiring increased cleaning, this can also result in altered process parameters in the subsequent processing zones, which can negatively affect the reproducibility of the subsequent processing.

Alternatively, WO2006045570A1 proposes increasing this adhesive capacity of the protectively coated steel sheet by modifying the natural oxide layer, without pickling this natural oxide layer as a result. Thus in the continuous process of providing the protective coating of the steel sheet, a cooling of the steel sheet with an aqueous composition or coolant is carried out, which is intended to improve the natural oxide layer of the protective coating, which contains Zn, Mg, and Al, for example. The aqueous composition can have soluble salts added to it to protect the natural oxide layer or phosphates to stabilize the sheet surface. But such a method cannot result in a remarkable increase in the adhesive capacity.

SUMMARY OF THE INVENTION

The stated object of the invention, therefore, is to create a method, based on the prior art explained at the beginning, with which the surface of the protective coating can be modified in the easiest way such that this significantly increases the adhesive capacity of the protectively coated steel sheet.

The invention attains the stated object in that the protectively coated steel sheet is skin-pass rolled and then the natural oxide layer is reacted with an aqueous fluoride-containing composition, reducing its MgO percentage, in order to thus modify the natural oxide layer.

If the protectively coated steel sheet is skin-pass rolled and then the natural oxide layer is reacted with an aqueous fluoride-containing composition, it surprisingly turns out to be possible to gently reduce the MgO percentage of the natural oxide layer of the protective coating. This modification of the oxide layer can result in a significant increase in the adhesive capacity, particularly with regard to gluing suitability and/or paintability of a protectively coated steel sheet. For example, it is also possible to improve the bonding of a glue in order to thus prevent an adhesive failure at the glue points. In particular, however, the invention can distinguish itself from the prior art in that this improved adhesive capacity can be achieved, without pickling the natural oxide layer. Specifically, by means of the skin-pass roiling according to the invention, the oxide layer can be activated for a depletion of MgO in reaction to fluoride. Al, which has a relatively high oxygen affinity, can thus increase in concentration primarily in the oxide layer and occupy the places in the oxide layer that are freed due to the MgO reduction. The latter can in particular contribute to a reduction in a diffusion of magnesium into the oxide layer or a reduction in magnesium breakthrough. The oxide layer that naturally forms on a Zn—Al—Mg protective coating can thus, for process-related reasons, easily be shifted in the direction of increased percentages of $Al_2O_3$ and/or ZnO and reduced percentages of MgO. A process with particularly good reproducibility can thus be achieved according to the invention.

In general, it should be noted that the unit of measure ppm is understood to be ppm by weight. In addition, it should also generally be noted that the improvement in the adhesive capacity can also result, for example, in advantages with regard to the adhesion strength. It should generally be stressed that the invention can be particularly well suited to improving the adhesive capacity of an organic coating to the protectively coated steel sheet.

Easily controllable processing conditions can be created if the fluoride dissolves MgO out of the oxide layer and conveys it into the aqueous composition. In addition, it is possible to retard the growth of a passivation layer, in particular of $MgF_2$, making it possible to retain the natural character of the oxide layer. Due to the fact that the quantity of fluoride in the aqueous composition is correspondingly set so as to dissolve Mg out of the oxide layer, it is possible to propose an easy-to-manage process regulation for reproducibly modifying the oxide layer.

For particularly advantageous process conditions in the targeted attack on the MgO of the oxide layer, the aqueous composition can contain from 20 to 3500 ppm F (fluoride), optionally 0 to 35000 ppm Na (sodium), 0 to 4000 ppm Al (aluminum), 0 to 4000 ppm Mn (manganese), 0 to 20 ppm P (phosphorus), 0 to 10 ppm Fe (iron), 0 to 10 ppm Ni (nickel), and/or 0 to 10 ppm Si (silicon), and a remainder of $H_2O$ (water) as well as inevitable impurities due to the manufacturing process. In addition, Al, Mn, Fe, Ni, P, and/or Si can be beneficial to the initiation of the MgO reduction or to the stabilization of the modified oxide layer. Concentrations amounting to less than 50 ppm can be viewed as inevitable impurities due to the manufacturing process.

A concentration of F of 20 to 3500 ppm, 5 to 3500 ppm, or preferably 5 to 1500 ppm in the aqueous composition can turn out to be advantageous for the targeted attack on MgO in the oxide layer or for dissolving out Mg. But even a concentration of F of 5 to 1500 ppm, 10 to 500 ppm, 20 to 150 ppm, 30 to 1500 ppm, or 30 to 300 ppm can turn out to be sufficient for this purpose.

The oxide layer that naturally forms on a Zn—Al—Mg protective coating can, for process-related reasons, easily be shifted in the direction of increased percentages of $Al_2O_3$ and reduced percentages of MgO if the aqueous composition contains Al. In this case, even a concentration of Al of greater than 2 ppm, in particular greater than 5 ppm, can be sufficient. Alternatively or in addition, Mn of greater than 3 ppm, in particular greater than 5 ppm, can conceivably be used to reduce the MgO percentage of the oxide layer.

If the aqueous composition contains a concentration of Al and/or Mn of 5 to 4000 ppm, 5 to 700 ppm, or 10 to 150 ppm, then this can already be sufficient to enable the above-mentioned effects.

For a sufficient reduction in MgO, the protective coating can be surface treated with the aqueous composition for 0.5 to 20 seconds, in particular 1.5 to 15 seconds. In addition, such a short treatment can be particularly well suited, as mentioned above, to a continuous process. It should be noted in general that depending on how high the ppm value of fluoride in the aqueous composition is, the treatment duration can turn out to be shorter. Thus for example with 1500 ppm fluoride, a treatment duration of 1.5 seconds can be sufficient while with 20 ppm fluoride, a treatment duration of 20 seconds should be sought in order to reduce the MgO content of the natural oxide layer without pickling the oxide layer.

By setting the pH value of the aqueous composition from 4 to 8, the reaction speed of the aqueous composition with the Zn—Al—Mg protective coating can be adapted to a band travel speed of the continuous process in a relatively simple way. In addition, setting the pH value to an acidic value results in an increased reduction of the MgO percentage in the oxide layer. But even a pH value of from 5 to 7.5 or 6 to 7 can be sufficient for this.

A temperature of the aqueous composition of from 30 to 95° C. (degrees Celsius) can be sufficient to further increase the speed of its reaction with the natural, i.e. native oxide layer. But a temperature of the aqueous composition of from 45 to 90° C. or 45 to 80° C. can turn out to be favorable for this purpose.

The aqueous composition can be produced in a simple way if NaF and/or $NaHF_2$ (bifluoride) is/are used.

The production of the aqueous composition can also occur in a relatively inexpensive fashion if $Na_3[AlF_6]$ (cryolite) is used. As a result, Na is also present in the aqueous composition. In this connection, an Na concentration of 5 to 35000 ppm or more is conceivable, in particular from 10 to 3500 ppm, and preferably from 20 to 2000 ppm.

The method according to the invention can particularly excel with a protective coating that contains 0.1 to 7 wt % aluminum, 0.2 to 5 wt % magnesium, and a remainder of zinc as well as inevitable impurities due to the manufacturing process Zn—Al—Mg protective coatings of this kind are particularly able to reduce the MgO percentage of an oxide layer with the same alloy composition as unmodified oxide layers, which can be used to significantly increase the adhesive capacity.

Preferably, the above-specified protective coating can contain 1 to 4 wt % aluminum and 1 to 3 wt % magnesium in order, in addition to improving the adhesive capacity, to also increase the reproducibility of the method.

The activation of the oxide layer for a subsequent surface treatment can be improved if in the skin-pass rolling of the steel sheet, skin-pass indentations are introduced into the protective coating. In addition, these skin-pass indentations, preferably in their edge regions, can constitute an improved attack target for fluoride in order to dissolve an increased quantity of MgO out from the natural oxide layer. In addition, the formation of magnesium fluoride ($MgF_2$) could be observed here or in this edge region, which can improve the adhesive capacity even further. In addition, after the surface treatment according to the invention, in the region of the skin-pass indentations, additional $Zn_5(OH)_6(CO_3)_2$ (zinc hydroxide carbonate) in lieu of ZnO can be observed, which can additionally improve the adhesive capacity.

The fluoride-containing aqueous composition can be easily removed from the surface of the protective coating if the protective coating, immediately after the surface treatment with the first fluoride-containing aqueous composition, is rinsed with a second liquid. In addition, this aftertreatment with such a liquid can additionally increase the removal of MgO; in particular, $H_2O$ can excel as the second liquid for this purpose.

If the second liquid contains up to 2.0 ppm P and/or Si as well as a remainder of $H_2O$ and inevitable impurities, then the MgO-reduced native oxide layer can be further stabilized. P can be expected to occur as phosphate in the liquid.

The rinsing action of the second liquid can be significantly improved if the second liquid has a temperature of 20 to 90° C. Preferably, the temperature can lie in a range from 35 to 85° C. or 40 to 75° C.

The rinsing duration can prove to be sufficient if the protective coating is rinsed with the second liquid for 1 to 10 seconds.

Simple process conditions can be established if the aqueous composition and/or the second liquid is/are applied to the protectively coated steel sheet using a spraying, dipping, or rolling method.

The method according to the invention can also prove successful if after the surface treatment of the protectively coated steel sheet, an organic layer is provided on the protective coating. A primer can be an example of such an organic layer.

In particular, the invention can distinguish itself from the known methods if an aqueous fluoride-containing composition is used to reduce the MgO percentage of the natural oxide layer of a Zn—Al—Mg protective coating on a skin-pass rolled steel sheet, without pickling the natural oxide layer as a result. In particular, a liquid with the composition according to one of claims 3 through 6 can excel for this purpose.

BRIEF DESCRIPTION OF THE DRAWINGS

The subject of the invention is shown in greater detail in an embodiment variant by way of example. In the drawings.

DETAILED DESCRIPTION OF THE PREFERRED EMBODIMENTS

Figure 1:
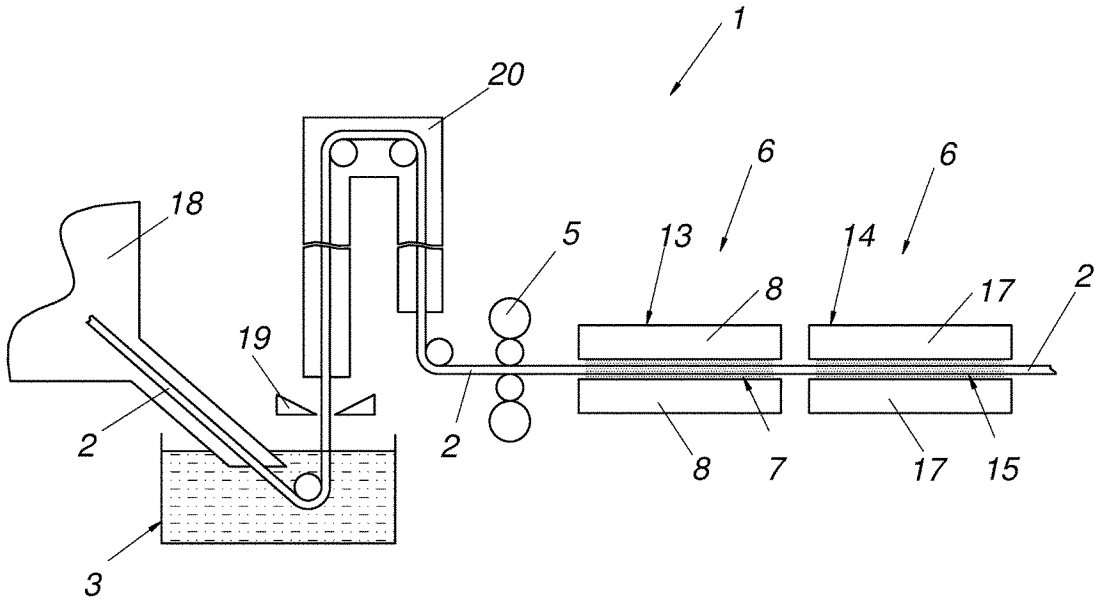
FIG. 1 shows a schematically depicted device for modifying the oxide layer of a steel sheet with a Zn—Al—Mg protective coating.
Figure 2:
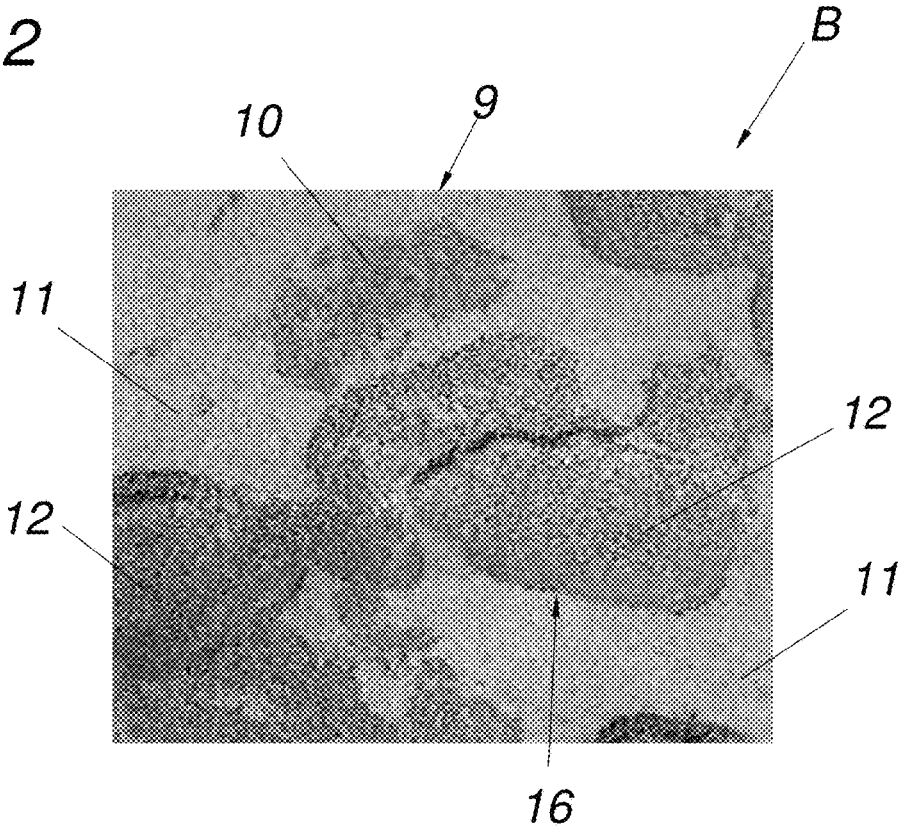
FIGS. 2 & 3 show top views of the native oxide layers of two coated steel sheets.

FIG. 1 shows an example of an apparatus I that makes it possible to carry out a continuous process for improving the adhesive capacity on a protectively coated steel sheet 2. In a continuous process, first a protective coating based on Zn—Al—Mg is applied to a moving steel sheet with the aid of a hot dip process 3. A hot dip process 3 is particularly taken to mean continuous hot-dip galvanizing (strip galvanizing)—but other coating processes are also conceivable. To illustrate the hot dip process 3, the depiction of the system parts of the apparatus 1 that relate to this has been restricted for the sake of clarity to a continuous furnace 18, a molten bath 3, a stripper 19 for adjusting the coating deposition, and a cooling unit 20. After the hot dip process 3 is carried out, the steel sheet 2 has a Zn—Al—Mg protective coating, which forms a natural oxide layer 9. As is known, this native oxide layer 9 contains $Al_2O_3$ 10, MgO 11, and also—albeit in a low quantity—ZnO 12. The percentage of MgO 11 in the oxide layer 9 is comparatively high, as can be seen in FIG. 2, According to FIG. 2, MgO 11 is visible as the light areas, $Al_2O_3$ 10 is visible as the dark areas, and ZnO 12 is visible as a mixture of light and dark areas. In a predominantly light MgO area on the surface of the Zn—Al—Mg protective coating, a significantly reduced adhesive capacity can be expected.

According to the invention, such predominantly MgO accumulations in the oxide layer 9 are avoided in that the steel sheet 2 that is provided with a Zn—Al—Mg protective coating is conveyed through a skin-pass rolling unit 5 and is thus prepared for the modification of its native oxide layer 9—i.e. prepared for a surface treatment 6 through the application of an aqueous fluoride-containing composition 7 in order to reduce the MgO percentage of the natural oxide layer 9, without pickling it. According to FIG. 1, this process step is implemented by means of spray bars 8 situated on both sides of the steel sheet 2, which apply or spray the aqueous fluoride-containing composition 7 onto the steel sheet 2. Instead of the spraying process 13, it is naturally also conceivable to carry out an application with a rolling or dipping process that is now shown in greater detail.

The aqueous composition subsequently dissolves MgO 11 out of the oxide layer 9 and conveys it into the aqueous composition 7. For this purpose, the quantity of fluoride in the aqueous composition 7, as measured by a fluoride-sensitive electrode, is adjusted in order to dissolve Mg out from the oxide layer 9. The percentage of MgO 11 in the native oxide layer 9 is thus reduced so that due to the high oxygen affinity of Al, more $Al_2O_3$ 10 can develop on the modified natural or native oxide layer 9.

Figure 3:
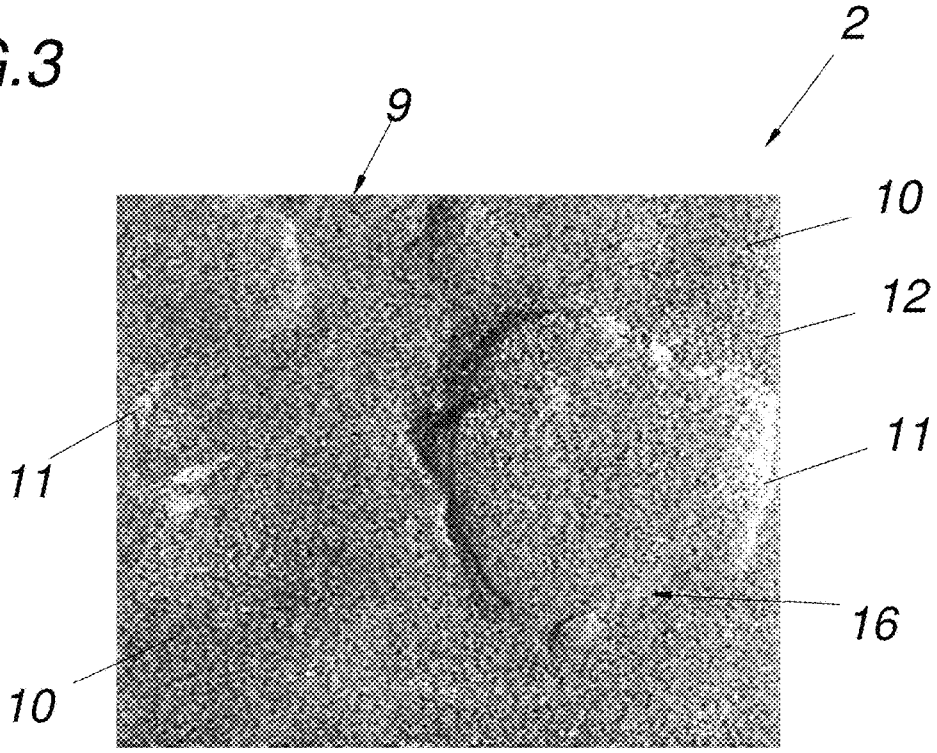

This situation is clearly visible in FIG. 3. FIG. 3 does in fact also show MgO 11 in light areas, but the percentage of MgO 11 is extremely low in comparison to FIG. 2. As a result, $Al_2O_3$ 10 (dark area) and ZnO 12 or $Zn_5(OH)_6(CO_3)_2$ (mixture of light and dark area) clearly predominate. The modified natural oxide layer 9 according to FIG. 3 essentially contains $Al_2O_3$ 10 and thus constitutes a barrier layer, which not only reduces a breakthrough of Mg into the oxide layer 9 to form MgO 11, but also reduces the diffusion of O through the oxide layer. Even with comparatively long storage times of the steel sheet 2, this modified natural oxide layer 9 still demonstrates a comparatively high adhesive capacity.

In order to increase the reaction speed, the pH value is set within a range from 4 to 8, particularly in the weakly acidic range; the aqueous composition should also have a temperature of 30 to 95° C. (degrees Celsius).

It was possible to establish particularly advantageous process conditions in the targeted attack on the MgO in the oxide layer if the aqueous composition contained 20 to 3500 ppm F (fluoride), optionally 0 to 35000 ppm Na (sodium), 0 to 4000 ppm Al (aluminum), 0 to 4000 ppm Mn (manganese), 0 to 20 ppm P (phosphorus), 0 to 10 ppm Fe (iron), 0 to 10 ppm Ni (nickel), and/or 0 to 10 ppm Si (silicon), and a remainder of $H_2O$ (water) as well as inevitable impurities due to the manufacturing process. But even a concentration of F of 5 to 3500 ppm, 5 to 1500 ppm. 5 to 1500 ppm, 10 to 500 ppm, 20 to 150 ppm, 30 to 1500 ppm, or 30 to 300 ppm can be sufficient.

In addition, even a presence of Al and/or Mn in the aqueous composition can turn out to be helpful for the method. In general, it should be noted that Al in the aqueous composition can improve the oxide layer by shifting it in the direction of elevated percentages of $Al_2O_3$ and reduced percentages of MgO. Specifically, Al in the aqueous composition 7 preferably settles in the reduced-Mg locations of the oxide layer. Such locations can be produced during treatment of the oxide layer with the aqueous composition 7, for example through the dissolution of MgO out of the oxide layer through conversion to MgOHF. A similar effect can also be achieved with Mn. It should also be noted that it can generally be conceivable for the protectively coated steel sheet 2 to be reacted with the aqueous fluoride-containing composition 7 in a way that reduces its MgO percentage, in that Mg and/or a magnesium compound (e.g. MgO 11) is dissolved out from the oxide layer 9 by means of fluoride and/or a fluoride compound (e.g. HF) and is replaced by Al and/or Mn in order to thus modify the natural oxide layer toward a reduced percentage of MgO.

The fluoride-containing aqueous composition 7, which has been applied to the steel sheet 2 by means of the spray bars 8, is removed from the steel sheet 2 with the aid of a rinsing unit that carries out a spraying process 14. To this end, immediately after the treatment by means of spray bars 17, the protective coating is surface treated with a second liquid 15. This second liquid 15 is composed of $H_2O$, but can also contain less than 20 mg/l of P or Si as well as inevitable impurities; the P may possibly be present in the form of phosphate in the liquid 15. A treatment duration of 1 to 10 seconds has been determined to be sufficient.

In addition, skin-pass indentations 16 that are produced by the skin-pass rolling unit 5 are present in the Zn—Al—Mg protective coating. According to FIGS. 2 and 3, the edges of the skin-pass indentations 16 are particularly evident in the form of closed contours. By contrast with FIG. 2, at the edge of the skin-pass indentation 16 according to FIG. 3, $MgF_2$ compounds can be detected, which are produced by means of the steel sheet 2 surface treatment according to the invention and increase the bonding of organic layers.

Six steel sheets were tested in order to prove the increased adhesive capacity according to the invention.

TABLE 1

Comparison of the steel sheets tested

| | Steel sheet | Coating | Tensile shear strength [MPa] | Fracture pattern |
|---|---|---|---|---|
| $A_1$ | DX53D | ZnAl2.5Mg1.5 | 20.5 | 100% SCF |
| $A_2$ | DX53D | ZnAl2.5Mg1.5 | 20.4 | 100% SCF |
| B | DX53D | ZnAl2.5Mg1.5 | 19.6 | 20% SCF and 80% AF |
| $C_1$ | DX56D | ZnAl2.4Mg2.2 | 19.8 | 100% SCF |
| $C_2$ | DX56D | ZnAl2.4Mg2.2 | 19.6 | 100% SCF |
| D | DX56D | ZnAl2.4Mg2.2 | 18.1 | 20% SCF and 80% AF |

The hot-dip galvanized steel sheets A ($A_1$ & $A_2$) and B have a deep-drawing grade of DX53D and a sheet thickness of 0.75 may ZnAl2.5Mg1.5 (96 wt %t Zn, 2.5 wt % Al, and 1.5 wt % Mg) was applied as a protective coating.

The hot-dip galvanized steel sheets C ($C_1$ & $C_2$) and D have a deep-drawing grade of DX56D and a sheet thickness of 0.7 mm, ZnAl2.4Mg2.2 (95.4 wt % Zn, 2.4 wt % Al, and 2.2 wt % Mg) was applied as a protective coating.

The steel sheets A ($A_1$ & $A_2$) and C ($C_1$ & $C_2$) underwent the modification of their oxide layers according to the invention, as shown in FIG. 1. This included a skin-pass rolling of the steel sheets A and B and an application of an aqueous composition 7 with a concentration of fluoride of 30 to 70 ppm by weight; the temperature of the aqueous composition 7 was set to approximately 70 degrees Celsius and its pH value was set in the range between 5 and 7.5.

Fluoride in the form of $Na_3[AlF_6]$ was added to the aqueous composition 7 for treating steel sheets $A_1$ and $C_1$. Consequently, this aqueous composition 7 is composed of fluoride, Na, Al, $H_2O$), and inevitable impurities of less than 10 ppm. NaF was added to the aqueous composition for treating steel sheets $A_2$ and $C_2$. If need be, this composition can be enriched with Al. Instead of or alternatively to NaF, it is also conceivable to use $NaHF_2$ (bifluoride). The steel sheets A ($A_1$ & $A_2$) and C ($_1$ & $C_2$) were treated with the respective aqueous composition for 10 seconds. Then the steel sheets A and C were rinsed with $H_2O$ for 10 seconds. This second liquid 15 was set to a temperature of 35 degrees Celsius.

The steel sheets B and D, however, did not undergo any surface treatment and thus essentially had an oxide layer as shown in FIG. 2.

All of the steel sheets A, B, C, and D were then provided with an organic coating, namely a single-component epoxy resin glue (e.g.: BM1496) and the adhesive capacity of the glue to the protective coating was determined by means of a tensile shear test.

Tests on the protectively coated steel sheets A, B, C, and D showed that only in the steel sheets A ($A_1$ & $A_2$) and C ($C_1$ & $C_2$) is it possible to avoid a fracture at the boundary surface between the oxide layer and the glue. This fracture is almost 100% SCF ("substrate close cohesive failure"), which corresponds to the fracture scenario required in the automotive sector. in the steel sheets B and D, as is to be expected, a mixed fracturing composed of 80% AF ("adhesive failure") and 20% SCF occurs, making these protectively coated steel sheets B and D unsuitable for the automotive sector. The method according to the invention can also clearly be recognized in the steel sheets A and C by an improved bonding of the glue to the protective coating, as evidenced by an increased tensile shear strength.

It is therefore clear that the method according to the invention is able to modify the oxide layer of the Zn—Al—Mg protective coating in a way that significantly improves the adhesive capacity for a glue on the protectively coated steel sheet A and C as compared to a steel sheet B and D according to the prior art.

The invention claimed is:

1. A method for improving the adhesive capacity of an organic coating to a protectively coated steel sheet, using a continuous process, comprising:

applying a protective coating based on Zn—Al—Mg to the steel sheet and, in a further step, applying a surface treatment to the protective coating that includes applying an aqueous fluoride-containing composition to the protective coating in order to modify a natural oxide layer, which contains $Al_2O_3$ and MgO, without pickling this natural oxide layer as a result, and skin-pass rolling the protectively coated steel sheet and then reacting the natural oxide layer with the aqueous fluoride-containing composition, reducing its MgO content in order to thus modify the natural oxide layer.

2. The method according to claim 1, wherein the fluoride dissolves MgO out of the oxide layer and transfers the MgO into the aqueous composition; and in order to accomplish this, the quantity of fluoride in the aqueous composition is correspondingly set to dissolve Mg out of the oxide layer.

3. The method according to claim 1, wherein the aqueous composition comprises:

| | | | |
|---|---|---|---|
| 20 | to | 3500 ppm | F, optionally |
| 0 | to | 35000 ppm | Na, |
| 0 | to | 4000 ppm | Al, |
| 0 | to | 4000 ppm | Mn, |
| 0 | to | 20 ppm | P, |
| 0 | to | 10 ppm | Fe, |
| 0 | to | 10 ppm | Ni, and/or |
| 0 | to | 10 ppm | Si, |

and a remainder of $H_2O$ as well as inevitable impurities due to the, manufacturing process.

4. The method according to claim 1, wherein the aqueous composition contains a concentration of F of 5 to 3500 ppm.

5. The method according to claim 1, wherein the aqueous composition contains Al and/or Mn.

6. The method according to claim 5, wherein the aqueous composition contains a concentration of Al and/or Mn of 5 to 4000 ppm.

7. The method according to claim 1, comprising surface treating the protective coating with the aqueous composition for 0.5 to 20 seconds.

8. The method according to claim 1, wherein the aqueous composition has a pH value of 4 to 8.

9. The method according to claim 1, wherein the aqueous composition has a temperature of 30 to 95° C.

10. The method according to claim 1, comprising using NaF and/or $NaHF_2$ when manufacturing the aqueous fluoride-containing composition.

11. The method according to claim 1, comprising using $Na_3[AlF_6]$ when manufacturing the aqueous fluoride-containing composition.

12. The method according to claim 1, wherein the protective coating contains 0.1 to 7 wt % aluminum, 0.2 to 5 wt % magnesium, and a remainder of zinc as well as inevitable impurities due to die manufacturing process.

13. The method according to claim 12, wherein the protective coating contains 1 to 4 wt % aluminum and 1 to 3 wt % magnesium.

14. The method according to claim 1, wherein during the skin-pass rolling of the steel sheet, skin-pass rolling pressures are introduced into the protective coating.

15. The method according to claim 1, wherein immediately after the surface treatment with the fluoride-containing aqueous composition, the method further comprises rinsing the protective coating with a second liquid.

16. The method according to claim 15, wherein the second liquid contains up to 20 ppm P and/or Si as well as a remainder of $H_2O$ and inevitable impurities.

17. The method according to claim 15, wherein the second liquid has a temperature of 20 to 90° C.

18. The method according to claim 15, comprising rinsing the protective coating with the second liquid for 1 to 10 seconds.

19. The method according to claim 15, comprising applying the aqueous composition and/or the second liquid to the protectively coated steel sheet using a spraying, dipping, or rolling method.

20. The method according to claim 1, further comprising, after the surface treatment of the protectively coated steel sheet, providing an organic layer on the protective coating.

* * * * *